United States Patent [19]

Aoki

[11] 4,307,644

[45] Dec. 29, 1981

[54] AUTOMATIC PERFORMANCE DEVICE

[75] Inventor: Eiichiro Aoki, Hamamatsu, Japan

[73] Assignee: Nippon Gakki Seizo Kabushiki Kaisha, Hamamatsu, Japan

[21] Appl. No.: 161,591

[22] Filed: Jun. 20, 1980

[30] Foreign Application Priority Data

Jun. 25, 1979 [JP] Japan ..... 54/79917

[51] Int. Cl.[3] ..... G10H 1/26; G10H 1/42

[52] U.S. Cl. ..... 84/1.03; 84/DIG. 12; 84/DIG. 22

[58] Field of Search ..... 84/1.01, 1.03, 1.17, 84/1.24, DIG. 12, DIG. 22

[56] References Cited

U.S. PATENT DOCUMENTS

| | | | |
|---|---|---|---|
| 3,624,263 | 11/1971 | Uchiyama | 84/1.03 |
| 4,080,862 | 3/1978 | Hiyoshi et al. | 84/1.24 |
| 4,158,978 | 6/1979 | Hiyoshi et al. | 84/1.03 |
| 4,163,407 | 8/1979 | Solender | 84/1.03 |
| 4,184,401 | 1/1980 | Hiyoshi et al. | 84/1.03 |
| 4,208,938 | 6/1980 | Kondo | 84/1.03 |
| 4,217,804 | 8/1980 | Yamaga et al. | 84/1.03 |
| 4,228,712 | 10/1980 | Uchiyama et al. | 84/1.01 |
| 4,232,581 | 11/1980 | Uchiyama | 84/1.03 |
| 4,248,119 | 2/1981 | Yamada | 84/1.01 |
| 4,263,829 | 4/1981 | Kaneko et al. | 84/1.03 |
| 4,267,762 | 5/1981 | Aoki et al. | 84/1.03 |

*Primary Examiner*—S. J. Witkowski

*Attorney, Agent, or Firm*—Spensley, Horn, Jubas & Lubitz

[57] ABSTRACT

An electronic musical instrument is of a type in which chord constituent tones are automatically produced at timings determined by the rhythm to be played and according to random selection of notes. A rhythm pattern pulse generator generates a rhythm pattern pulse representing the timings of tones to be sounded according to the selection of the rhythm. A constituent degree data generator generates, at the timings of the rhythm pattern pulse, degree data signals representing degrees of chord constituent notes, wherein the degrees are aligned in a random order. Tones are produced of the notes designated by the degrees and the root note of the chord. Thus an automatic performance is realized with the notes constituting a chord but appearing in a random order.

10 Claims, 9 Drawing Figures

TO KEY DATA PROCESSING CIRCUIT 5
SD
NUMERIC MEMORY
74
(1)
(3)
(5)
17
OR5
OR6
OR7
A9
A11
A8
A12
A10
A13
Rc
S1
S2
S3
RANDOM DATA GENERATOR
73
OR4
PP
PP1
PP2
PP3
PATTERN MEMORY
722
AS
ADDRESS GENERATOR
71
TP
FROM TEMPO PULSE OSCILLATOR 6
Cp
16
S
Q
FF
R
15
COUNTER
R
14
A COMPARATOR B
A≠B
RKD'
13
REGISTER
TO KEY DATA PROCESSING CIRCUIT 5
RKD
4
CODE DETECT-ING CIRCUIT
FROM LOWER KEYBOARD 2

AUTOMATIC PERFORMANCE DEVICE

BACKGROUND OF THE INVENTION

This invention relates to an automatic performance device by which automatic performance tones such as automatic bass tones and automatic arpeggio tones are produced at a random or irregular order, thereby to eliminate the monotony in an automatic performance, or to make the automatic performance rich in variation.

An automatic performance device has been known, in the art, in which an automatic performance is carried out according to a performance pattern (such as a bass pattern or an arpeggio pattern) preset. However, since such a conventional automatic performance device carries out only an automatic performance corresponding to a performance pattern of a preset note order, the automatic performance is not rich in variation. This is one of the factors which make the automatic performance dull.

For instance, an automatic bass performance device for automatically producing bass tones is so designed that a reference note (root note) specified by the depression of a key or keys, for instance, in the lower keyboard, and notes (subordinate notes) having predetermined relationships with the reference note are successively, one at a time, selected and produced as tones at preset bass tone production timings and according to a bass pattern representative of note selection information. The bass pattern is determined merely according to a selected rhythm and a specified kind of chord. Therefore, if the selected rhythm and specified kind of chord are maintained unchanged, then the same bass performance is merely repeated according to the bass pattern thus determined. Thus, the bass performance is musically dull or monotonous. This will become more apparent from the part (a) of FIG. 1. In the part (a), the same chord C appears continuously for four measures. For the four measures, a bass performance is repeatedly carried out according to the same bass pattern corresponding to the chord C. Thus, the bass performance is considerably monotonous.

SUMMARY OF THE INVENTION

Accordingly, an object of this invention is to provide an automatic performance device in which automatic performance tones are sounded in a random order thereby to carry out an automatic performance rich in variation.

DETAILED DESCRIPTION OF THE INVENTION

Figure 1:
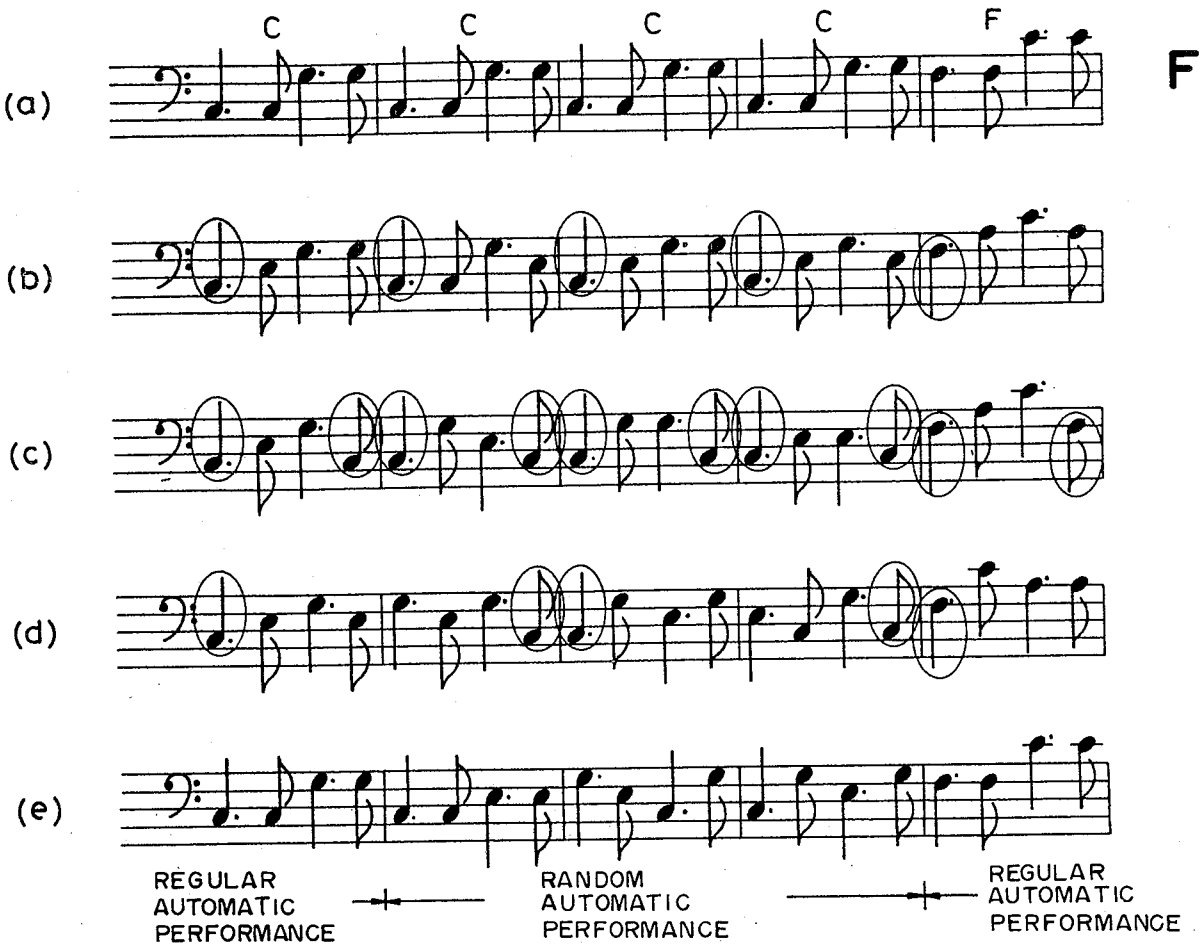
FIG. 1 shows musical staves indicating examples of notes performed by an automatic performance device.

If an automatic performance device is so designed that tones to be produced and the tone production timings thereof are selected completely at random, then the musical nature of the performance as chord and rhythm is lost; that is, it cannot be considered as a musical instrument. Therefore, in an automatic performance device according to the invention, only the order of tone production are selected at random with the tones to be produced and the tone production timings thereof maintained in predetermined relation.

In the automatic performance device of the invention, a specified reference note (root note) and notes (subordinate notes) in predetermined relation with the reference note are successively, one at a time, selected and produced at random but at predetermined tone production timings.

It is assumed that the specified root note is note C and its subordinate notes are notes E and G. In this case, the three notes C, E and G are successively, one at a time, selected and produced at random but at predetermined timings (corresponding to a selected rhythm, for instance). In other words, tones to be produced are limited to the three notes C, E and G, and the tone production timings correspond to the selected rhythm; however, the tones C, E and G are selected at random for the respective timings.

In this case, the musical nature as chord and rhythm of the performance is maintained satisfactory, and yet the tones to be produced are selected at random. Thus, the automatic performance is rich in variation.

The automatic performance device may be so designed that selection of the tones is carried out freely; that is, any note appears as often as other notes (by the same probability). However, in view of musical requirements, it is preferable that tones to be produced are selected under certain conditions, i.e. the random selection of tones is limited to a certain extent.

Thus, the invention provides an automatic performance device in which selection of tones to be produced is carried out under the following conditions:

(1) The note at the top of a measure is forcibly selected as the root note (reference note).

In this case, while the note at the top of a measure is forcibly selected as a root note (reference note), the other notes in a measure are randomly selected from among the root note and the subordinate notes which are in predetermined relation with the root note. One example of this is as shown in the part (b) of FIG. 1, in which the forcible root notes are encircled.

(2) The notes at the top and last of a measure are forcibly selected as the root note.

In this case, while the notes at the head and tail of a measure are forcibly selected as a root note, the other notes in a measure are randomly selected from among the root note and the subordinate notes which are in predetermined relation with the root note. One example of this is as shown in the part (c) of FIG. 1, in which the forcible root notes are encircled.

(3) The notes at the top and last of a phrase with plural measures as one unit are forcibly selected as the root note.

In this case, while the notes at the head and tail of a phrase consisting of two measures as one unit are forcibly selected as a root note, the other notes in a phrase are randomly selected from among the root note and the subordinate notes which are in predetermined relation with the root note. One example of this is as shown in the part (d) of FIG. 1, in which the forcible root notes are encircled.

(4) The tone production oftenness of the root note and the subordinate notes are set to predetermined values in advance, respectively.

In this case, the tone production oftenness of the root note and the subordinate notes are set to predetermined values; however, these notes are produced as tones at random (i.e. it is unknown what note is produced at a given tone production timing). For instance, if, in the case where notes of a third degree and a fifth degree with respect to the root note (prime degree) are the subordinate notes, a ratio of the tone production oftenness of the third degree note to that of the root note (prime degree) and that of the fifth degree note is set to 1:2, then the third degree note is sounded as a tone at a tone production oftenness of $\frac{1}{2}$ with respect to the tone production of the root note and the fifth note, and these notes are produced as tones at random order; however, the automatic performance is stable in tonality (key).

Furthermore, in the device of the invention, the above-described random automatic performance and a regular automatic performance according to a predetermined performance pattern are switched according to a condition that a specified chord is maintained unchanged for more than a predetermined number of measures.

Accordingly, in such a device, normally a regular automatic performance is carried out according to a predetermined performance pattern; however, when the same chord is maintained specified for more than a predetermined number of measures, then the regular automatic performance is automatically switched over to a random automatic performance. In addition, when a new chord is specified, the random automatic performance is switched back to the regular automatic performance conducted according to the predetermined performance pattern.

One example of the performances which are carried out by the device is shown in the part (e) of FIG. 1. In the part (e), the same chord C is specified continuously for four measures, and it is changed to a chord F. In this case, a condition to switch the regular automatic performance over to the random automatic performance is that the same chord is specified continuously for more than one measure.

More specifically, the same chord C is specified continuously for four measures, and the regular automatic performance according to the predetermined performance pattern is carried out for the first one of the four measures, and the random automatic performance is carried out for the remaining three measures (the second, third and fourth measures). For the fifth measure, the chord F is newly specified, and therefore the random automatic performance is switched back to the regular automatic performance.

The random automatic performance may be such that no condition is given to it so that each note has the same tone production oftenness, or at least one of the above-described conditions (1) through (4) is given to it so that its random selection of notes is limited to a certain extent.

Figure 2:
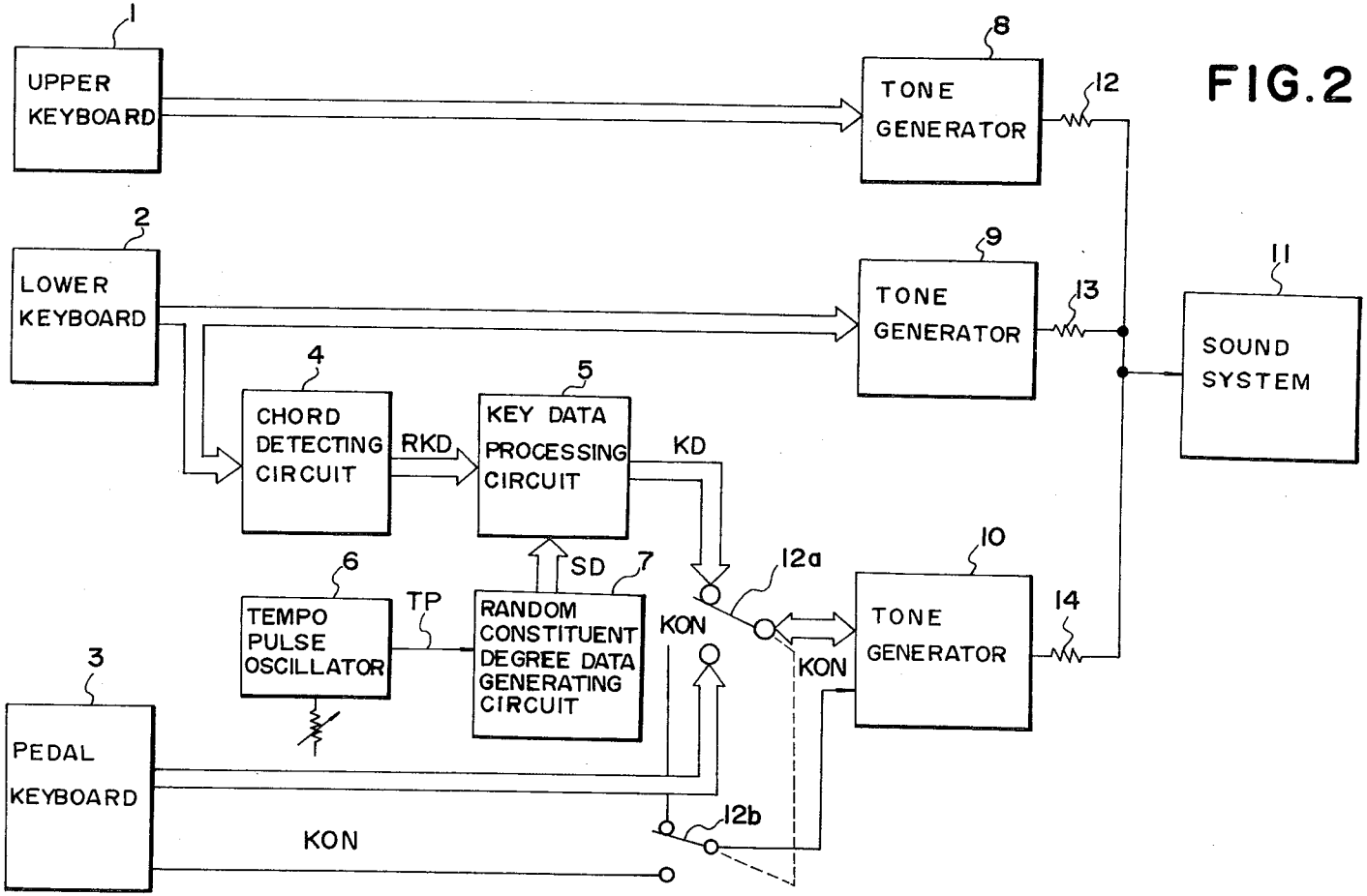
FIG. 2 is a block diagram showing one example of the automatic performance device of this invention.

One example of the automatic performance device according to this invention, as shown in FIG. 2, comprises: an upper keyboard 1; a lower keyboard 2; and a pedal keyboard 3. The automatic performance device is so designed that a bass tone is automatically performed according to keys depressed in the lower keyboard 2. The upper keyboard 1 is adapted to mainly perform melodies, the lower keyboard 2 chords, and the pedal keyboard 3 bass tones. A tone generator 8 for forming musical tone signals of melody tones, a tone generator 9 for forming musical tone signals of chord tones, and a tone generator 10 for forming musical tone signals of bass tones are provided in correspondence to the upper keyboard 1, the lower keyboard 2 and the pedal keyboard 3, respectively. These tone generators are coupled to a sound system 11 having means such as a loudspeaker, etc. for converting electrical signals into audible sounds. That is, the sound system 11 operates to convert musical tone signals from the tone generators 8, 9 and 10 into musical sounds.

When a key in the upper keyboard 1 is depressed, the upper keyboard 1 produces a signal representative of the key. The signal thus produced may be a signal of ON from one of individual key outputs of a number corresponding to the number of the keys, or a coded signal having a plurality of bits. The coded signal is, for instance, a key code of seven (7) bits which consists of a 4-bit note code and a 3-bit octave code.

The depressed key representing signal provided by the upper keyboard 1 is applied to the tone generator 8. According to the signal thus applied, the tone generator 8 forms a musical tone signal corresponding to the depressed key. The tone generator 8, in general, has a plurality of tone production channels, so that when a plurality of signals representative of depressed keys (hereinafter referred to as "key depression signals" when applicable) are provided, the key depression signals are assigned to respective available ones of the plurality of tone production channels, where the respective musical tone signals are formed. The musical tone signals formed by the tone generator 8 are applied through a mixing resistor 12 to the sound system 11, where they are produced as musical sounds (melody tones).

The production of musical tones in response to the depression of keys in the lower keyboard 2 and the pedal keyboard 3 depends on the position of the movable contacts of automatic performance selecting switches 12*a* and 12*b*.

It is assumed that the movable contacts of the automatic performance selecting switches 12*a* and 12*b* have been tripped over to the opposite side (from the indicated side in the figure). When, under this condition, keys are depressed in the lower keyboard 2, key depression signals are provided by the lower keyboard 2 similarly as in the upper keyboard 1. The signals thus provided are applied to the tone generator 9. In the tone generator 9, musical tone signals corresponding to the depressed keys are formed according to the key depression signals. The musical tone signals are applied through a mixing resistor 13 to the sound system 11, in which they are produced as musical sounds (chord tones). Similarly, when a key is depressed in the pedal keyboard 3, a key depression signal representative of the depressed key is provided by the pedal keyboard and is applied through the automatic performance selecting switch 12*a* to the tone generator 10. According to the key depression signal, the tone generator 10 forms a musical tone signal representing a bass tone. The bass tone is a percussive tone, and therefore a key-on signal KON which is produced by the pedal keyboard 3 upon key depression and applied through the switch 12*b* is employed for the formation of a bass tone. The key-on signal KON is raised to a logical level "1" (hereinafter referred to merely as "1" when applicable) only for a predetermined period of time (for instance 30 ms) immediately after the depression of a key. The musical tone signal formed by the tone generator 10 is applied through a mixing resistor 14 to the sound system, where it is produced as a musical sound (bass tone).

Now, it is assumed that the movable contacts of the automatic performance selecting switches 12*a* and 12*b* are positioned as indicated in FIG. 2. When, under this condition, keys are depressed in the lower keyboard 2, the tone generator 9 is driven as described above to produce chord tones, while the tone generator 10 is driven as described below, to carry out a random automatic bass performance.

The key depression signal(s) produced by the lower keyboard 2 in response to the depression of a single or plural keys in the lower keyboard 2 is applied to a chord detecting circuit 4. The chord detecting circuit 4 operates to detect from the interval relationship of the key depression signal(s) applied thereto whether or not a chord is established. When a chord is established, the chord detecting circuit 4 delivers out a signal representative of the root note of the chord, as a root note key data RKD. When no chord is established (including the case where a single key is depressed in the lower keyboard 2), the lowest one of the depressed keys is regarded as the root note (when a single key is depressed in the lower keyboard 2, that single key is regarded as the root note), and a signal representative of the lowest note is delivered as the root note key data RKD. In the chord detection operation by the chord detecting circuit 4, the difference in octave of the keys depressed in the lower keyboard 2 is disregarded. For instance, when note C in the second octave and notes E and G in the first octave are depressed in the lower keyboard, they are processed similarly as in the case where notes C, E and G in the same octave are depressed, and the signal representative of the lowest note is a signal representing note C. The root note key data RKD is adapted to represent a note only, and its octave range is predetermined. In order to allow the root note key data RKD to represent twelve (12) notes, a 4-bit code signal can be used as the data RKD.

A random constituent degree data generating circuit 7 is driven by a tempo pulse oscillator 6 whose oscillation frequency can be varied, to provide a constituent degree data SD as well as a key-on signal KON representative of the tone production timing of an automatic bass tone with the predetermined timing which is determined by a selected rhythm (a rhythm selecting means is not shown, but it may be, for instance, a rhythm selecting switch). The constituent degree data SD represents degree information of the constituent note with respect to the above-described root note, and for instance it represents the prime degree, the third degree, or the fifth degree. However, it should be noted that the random constituent degree data generating circuit 7 is so designed that it provides the degree data at random order; that is, it has a random probability as to what degree data is produced at a given timing. More specifically, the circuit 7 is so designed that, while the generation timing of the constituent degree data SD is determined by the oscillation frequency of the tempo pulse oscillator 6 and the selected rhythm, a random probability is given to the contents of the constituent degree data SD (the production of degree data at a given timing).

A key data processing circuit 5 operates to process the root note key data RKD from the chord detecting circuit 4 with the aid of the constituent degree data SD from the random constituent degree data generating circuit 7, thereby to form key datas KD representative of constituent notes having predetermined interval relationship with respect to the root note. The key data processing circuit 5 can be constituted by an addition circuit adapted to subject the root note key data RDK and the constituent degree data SD to addition. In this case, the constituent degree data SD provided by the random constituent degree data generating circuit 7 is, for instance, a 4-bit data corresponding to the interval from the root. The key data processing circuit 5 may be similar in arrangement to a circuit which is disclosed in U.S. Pat. Application Ser. No. 940381 entitled "Key CODE Data Generator" now U.S. Pat. No. 4,228,712 or in the unexamined publication No. 1979-43014 of the corresponding Japanese patent application.

Figure 3:
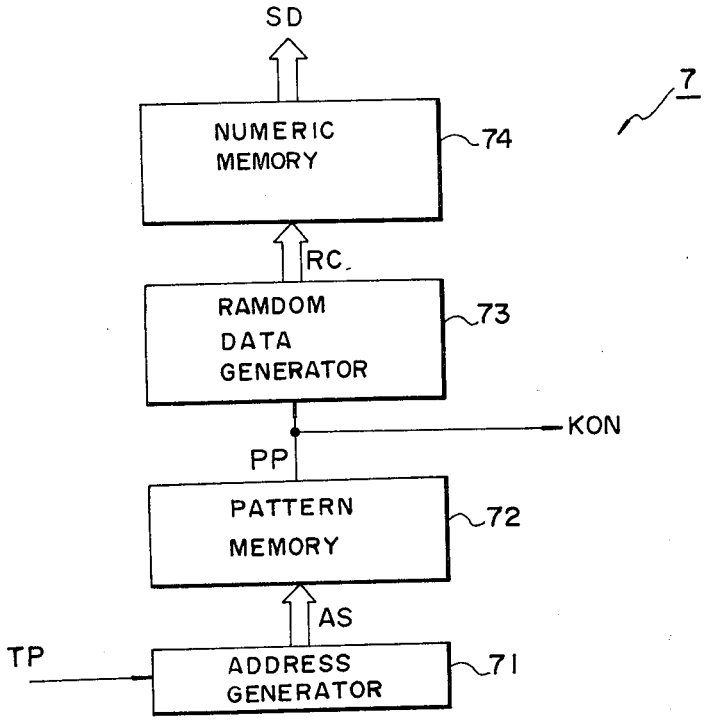
FIG. 3 is a block diagram showing one example of the arrangement of a random constituent degree data generating circuit in FIG. 2.

One example of the random constituent degree data generating circuit 7 is as shown in FIG. 3.

In FIG. 3, an address generator 71 is driven by the tempo pulse TP from the tempo pulse oscillator 6 (FIG. 2), to provide addressing signal AS to address a pattern memory 72. The address generator 71 is, for instance, constituted by a 5-bit binary counter whose parallel bit outputs are employed as the addressing signal AS. The pattern memory 72, storing a pattern pulse PP representing the tone production timings for an automatic bass performance, reads out the pattern pulse PP in response to the addressing signal AS from the address generator 71. The pattern memory 72 may be constituted by a read-only memory (ROM). In practice, a plurality of pattern pulses PP are stored in the pattern memory 72 in correspondence to plural kinds of rhythms, and a desired pattern pulse PP can be selected by operating a rhythm selecting switch (not shown).

The pattern pulse read out of the pattern memory 72 is taken out as the key-on signal KON representative of the tone production timings for an automatic bass tone.

Figure 4:
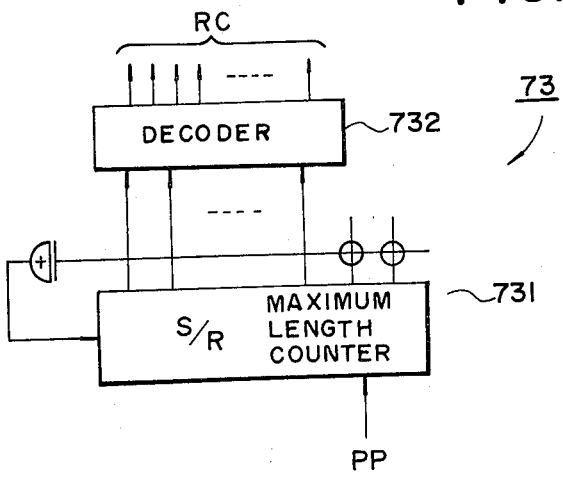
FIG. 4 is a block diagram showing one example of the arrangement of a random data generator in FIG. 3.

The pattern pulse PP from the pattern memory 72 is applied to a random data generator 73. The random data generator 73, as shown in FIG. 4, comprises a maximum length counter 731 and a decoder 732 connected thereto, to output a pulse signal synchronous with the pattern pulse PP to one, at a time, of the individual output lines thereof. The output (random data RC) of the random data generator 73 is used to select one out of the notes consisting of the root note and the subordinate notes.

The random data RC from the random data generator 73 is applied to a numeric memory 74, which is constituted by a read-only memory (ROM) which receives the random data RC as an addressing signal. In the numeric memory 74, the numeric data (addend values) representing the intervals of the root note and the subordinate notes with respect to the root note are stored in the addresses. The numeric data of the root note (prime degree) is zero (0). Thus, the numeric memory 72 reads out the numeric data of the root note or of each subordinate note according to the random data RC from the random data generator 73. The numeric data read out of the memory 74 are applied, as the constituent degree data SD, to the key data processing circuit 5 (FIG. 2). The generation timings of the constituent degree data SD thus provided are synchronous with the pattern pulse PP which is provided by the pattern memory 72; however, which corresponds to one of the notes at random.

In the key data processing circuit 5 (FIG. 2), the root note key data RKD representative of the root note is processed with the aid of the constituent degree data SD, to form the key data representing the root note and the subordinate notes. Since the generation timing of the constituent degree data SD is synchronous with the pattern pulse PP; however,it randomly corresponds to one of the notes as was described above, the key data KD representing the root note and those representing the subordinate notes are outputted one after another but at random by the key data processing circuit 5.

The key data KD outputted by the key data processing circuit 5 is applied through the automatic performance selecting switch 12*a* to the tone generator 10, while the key-on signal KON outputted by the random constituent degree data generating circuit 7 is applied through the automatic performance selecting switch 12*b* to the tone generator 10. The tone generator 10 forms a musical tone signal representative of the root note or the subordinate note according to the key data KD and the key-on signal KON. The musical tone signal thus formed is applied through the mixing resistor 14 to the sound system 11, where it is sounded as the automatic bass tone.

As is clear from the above description, an automatic bass performance is carried out in which, while tones produced by the sound system 11 are in predetermined relation with the tone production timing, a tone is selected at random at each tone production timing.

Figure 5:
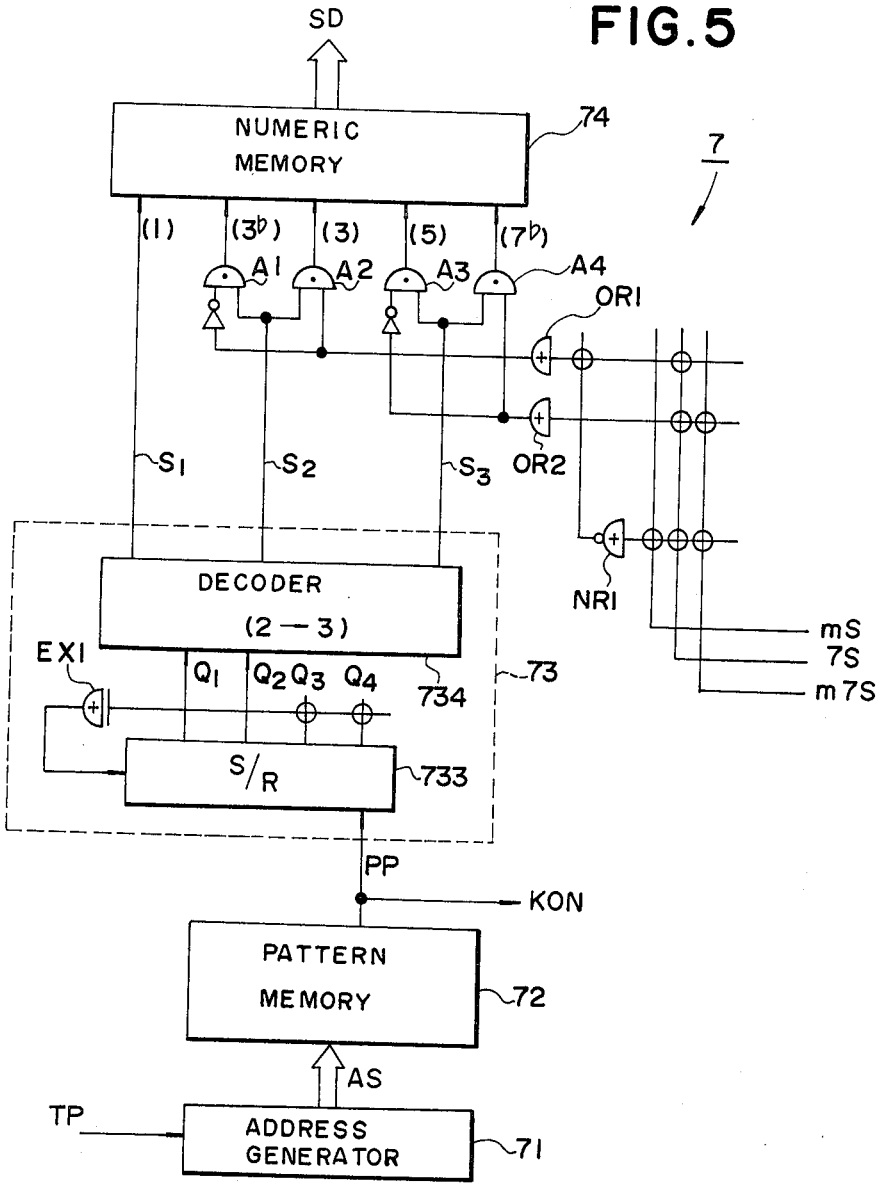
FIGS. 5 and 6 are block diagrams respectively showing second and third examples of the random constituent degree data generating circuit in FIG. 2.

For convenience in description, the example of the random constituent degree data generating circuit 7 in FIG. 3 is such that changing the degrees of the subordinate notes with respect to the root note according to the kinds of chord is not carried out. Another example of the random constituent degree data generating circuit 7 in which changing the degrees of the subordinate notes with respect to the root note according to the kinds of chord is shown in FIG. 5. That is, in the circuit 7 in FIG. 5, the degrees of subordinate notes with respect to the root note are changed according to the kinds of chord which are major triad (M), minor triad, dominant seventh (7) and minor seventh chords. In the following figures, like parts which are similar in circuit arrangement to those in FIG. 3 are designated by like reference numerals or characters, and the descriptions of them are omitted.

In FIG. 5, an address generator 71 provides an addressing signal AS in response to the tempo pulse TP, and a pattern memory 72 produces a pattern pulse PP defining the tone production timings of an automatic bass performance according to the address signal AS. The pattern pulse PP thus produced is applied to a random data generator 73 which comprises: a 4-stage shift register 733 forming a maximum length counter; and a decoder 734 for decoding a 2-bit coded signal into one of three individual signals. In the initial state, the contents of all the stages of the shift register 733 are all reset to "1". When the pattern pulse PP is applied to the address generator 71 and the pattern pulse PP is produced by the pattern memory 72, the content of each stage of the shift register 733 is shifted rightward in response to the pattern pulse PP. The output signals Q3 and Q4 of the third and fourth stages of the shift register 733 are applied to an EXCLUSIVE OR circuit EX1, the output of which is applied to the first stage of the shift register 733. Accordingly, the output signals Q1 through Q4 of the stages of the shift register 733 are changed in response to the pattern pulse PP as indicated in Table 1 below:

TABLE 1

| | Q1 | Q2 | Q3 | Q4 |
|---|---|---|---|---|
| 1 | 1 | 1 | 1 | 1 |
| 2 | 0 | 1 | 1 | 1 |
| 3 | 0 | 0 | 1 | 1 |
| 4 | 0 | 0 | 0 | 1 |
| 5 | 1 | 0 | 0 | 0 |
| 6 | 0 | 1 | 0 | 0 |
| 7 | 0 | 0 | 1 | 0 |
| 8 | 1 | 0 | 0 | 1 |
| 9 | 1 | 1 | 0 | 0 |
| 10 | 0 | 1 | 1 | 0 |
| 11 | 1 | 0 | 1 | 1 |
| 12 | 0 | 1 | 0 | 1 |
| 13 | 1 | 0 | 1 | 0 |
| 14 | 1 | 1 | 0 | 1 |
| 15 | 1 | 1 | 1 | 0 |
| 1 | 1 | 1 | 1 | 1 |

Among the outputs of the shift register 733 which are successively changed in response to the pattern pulse PP from the pattern memory 72, the first and second stage output signals Q1 and Q2 are applied to the decoder 734, in which the 2-bit signal Q1, Q2 is decoded into three individual signals S1, S2, S3, for instance as shown in Table 2 below:

TABLE 2

| Q1 | Q2 | S1 | S2 | S3 |
|---|---|---|---|---|
| 0 | 0 | 1 | 0 | 0 |
| 1 | 0 | 1 | 0 | 0 |
| 0 | 1 | 0 | 1 | 0 |
| 1 | 1 | 0 | 0 | 1 |

In the case of Table 2, the probability that the signal S1 is raised to "1" is higher than the probability that the signal S2 or S3 is raised to "1". However, if the arrangement of the decoder 734 is suitably designed, then it is possible to respectively raise the signals S1, S2 and S3 to "1" in appropriate probabilities, respectively.

The signal S1 provided by the decoder 734 is applied as a prime degree specifying signal (1) to the numeric memory 74, the signal S2 is applied to AND circuits A1 and A2, and the signal S3 is applied to AND circuits A3 and A4. The operations of these AND circuits A1 through A4 are controlled by chord kinds specifying signals, i.e. a minor triad specifying signal mS, a dominant seventh specifying signal 7S and a minor seventh specifying signal m7S. When the minor triad specifying signal mS is at "1", the kind of chord is minor triad (m). When the dominant seventh specifying signal 7S is at "1", the kind of chord is dominant seventh (7). When the minor seventh specifying signal m7S is at "1", the kind of chord is minor seventh (m7). When all of the minor triad specifying signal (m), dominant seventh specifying signal (7S) and minor seventh specifying signal (m7S) are at "0", the kind of chord is major triad (M). The minor specifying signal mS, the seventh specifying signal 7S and the minor seventh specifying signal m7S can be provided by operating a suitable chord kind specifying switch (not shown). Or alternatively, these signals mS, 7S and m7S can be produced according to the detection of the chord in the chord detecting circuit 4 in FIG. 2.

The minor specifying signal mS, the seventh specifying signal 7S and the minor seventh specifying signal m7S are applied to a NOR circuit NR1. The output of the NOR circuit NR1 and the seventh specifying signal 7S are applied to an OR circuit OR1. The output of the OR circuit OR1 is applied through an inverter to the other input of the AND circuit A1. The output of the OR circuit OR1 is applied directly to the other input of the AND circuit A2. The seventh specifying signal 7S and the minor seventh specifying signal m7S are applied to an OR circuit OR2, the output of which is applied through an inverter to the other input of the AND circuit A3. The output of the OR circuit OR2 is applied directly to the other input of the AND circuit A4. Accordingly, when a condition "$\overline{(mS+7S+m7S)}+7S$" is at "1", i.e. when the specified chord kind is the major (M) or the seventh (7), the AND circuit A2 is enabled. When the condition is at "0", i.e. when the specified chord kind is not the major (M) nor the seventh (7), the AND circuit A1 is enabled. When a condition "7S+m7S" is at "1", i.e. when the specified chord kind is the seventh (7) or the minor seventh (m7), the AND circuit A4 is enabled. When the condition "7S+m7S" is at "0", i.e. when the specified chord kind is not the seventh (7) nor the minor seventh (m7) (that is, the specified chord kind is the major (M) or the minor (m)), the AND circuit A3 is enabled. The outputs of the AND circuits A1, A2, A3 and A4 are applied as a minor third degree specifying signal (3*b*), a major third degree specifying signal (3), a perfect fifth degree specifying signal (5) and a minor seventh degree specifying signal (7*b*) to the numeric memory 74, respectively. The relationships between the output signals S1 through S3 of the decoder 73 and the degree specifying signals (1), (3*b*), (3), (5) and (7*b*) are as indicated in Table 3, with respect to the specified chord kinds of major (M), minor (m), seventh (7) and minor seventh (m7).

TABLE 3

| | S1 | S2 | S3 |
|---|---|---|---|
| (M) | (1) | (3) | (5) |
| (m) | (1) | (3b) | (5) |
| (7) | (1) | (3) | (7b) |
| (m7) | (1) | (3b) | (7b) |

When the specified chord kind is major (M), in correspondence to the output signals S1 through S3 of the decoder 734 the prime degree specifying signal (1), the major third degree specifying signal (3) and the fifth degree specifying signal (5) are applied to the numeric memory 74. When the specified chord kind is minor (m), the prime degree specifying signal (1), the minor third degree specifying signal (3*b*) and the fifth degree specifying signal (5) are applied to the memory 74. When the specified chord kind is seventh (7), the prime degree specifying signal (1), the major third degree specifying signal (3) and the minor seventh degree specifying signal (7*b*) are applied to the memory 74. When the specified chord kind is minor seventh (m7), the prime degree specifying signal (1), the minor third degree specifying signal (3*b*) and the minor seventh degree specifying signal (7*b*) are applied to the memory 74.

The numeric memory 74, storing numeric data (addend values) representative of a prime degree, a minor third degree, a major third degree, a fifth degree and a minor seventh degree respectively corresponding to the prime degree specifying signal (1), the minor third degree specifying signal (3*b*), the major third degree specifying signal (3), the fifth degree specifying signal (5) and the minor seventh degree specifying signal (7*b*), reads out the numeric data (addend values) representative of the degrees in response to the signals (1), (3*b*), (3), (5) and (7*b*). The numeric data (addend values) read out of the numeric memory 74 is applied as the constituent degree data SD to the key data processing circuit 5.

Figure 6:
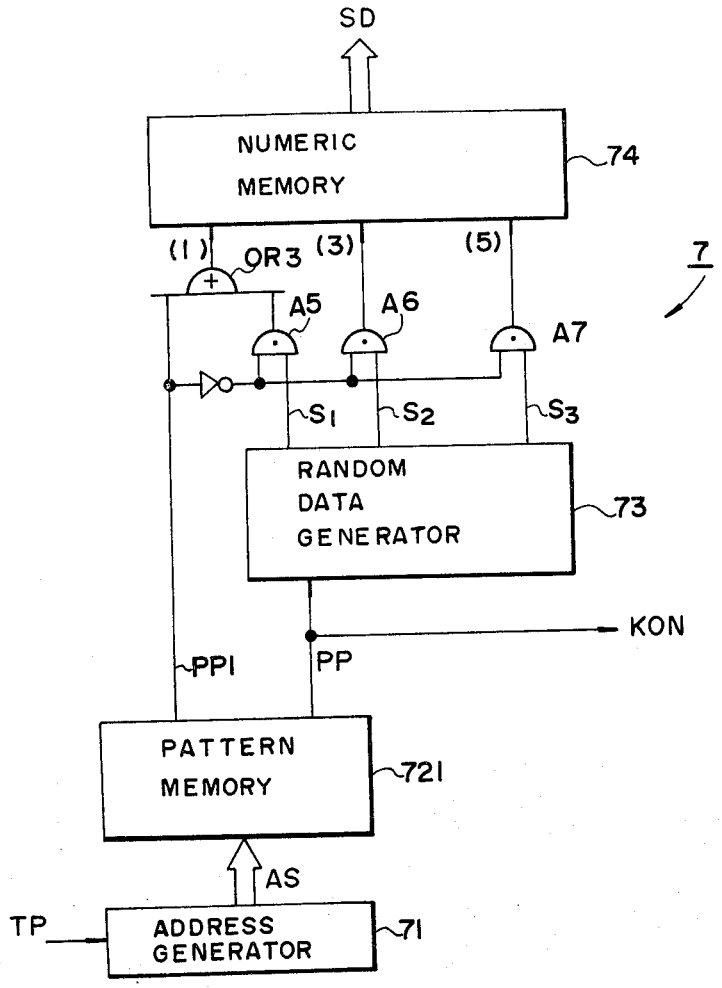

Shown in FIG. 6 is a third example of the random constituent degree data generating circuit 7, in which the note at the top of every measure is forcibly selected as the root note, and the remaining notes are processed at random. In this example, the pattern memory 721 is so designed that it provides a signal (pattern pulse) PP1 specifying a prime degree note (root note) at a particular tone production timing in addition to the pattern pulse PP.

In FIG. 6, an address generator 71 is constituted by a plural-bit counter which is driven by the tempo pulse TP, the parallel bit outputs of the address generator 71 being employed as the addressing signal AS. Accordingly, the addressing signal AS specifies the same address every time one cycle of counting operation of the counter is achieved. The pattern memory 721 is adapted to store the pattern pulses PP for the measures whose number is equal to the measure number constituting the above described one cycle. More specifically, the pattern memory 721 stores in the addresses the pattern pulses PP indicating the tone production timings of the above-described automatic bass performance, and stores in a particular address corresponding to particular tone production timing a signal PP1 (prime degree pattern pulse) indicating the tone production timings of the prime degree note.

For instance, the pattern memory 721 is so designed that, in order to provide the prime degree indicating signal PP1 at the timing of the first beat in each measure, the signal PP1 is stored in an address corresponding to the first beat in the measure, and the signal PP1 is read at that timing.

Furthermore, in order to provide the signal PP1 at the timings of the first and last beats in each measure, the pattern memory 721 is so designed that the signal PP1 is stored in addresses corresponding to the first and last beats in the measure, and the signal PP1 is read at the timings of the first and last beats.

In order to produce the signal PP1 at the timings of the first and last beats in a phrase of two measures as one unit, the pattern memory 721 is so designed that the signal PP1 is stored in addresses corresponding to the first and last beats of the phrase, and the signal PP1 is read at the timings of the first and last beats of the phrase. For this purpose, it is necessary for the pattern memory 721 to store a pattern for two measures.

The prime degree indicating signal PP1 outputted by the pattern memory 721 at the particular timings is applied, as the prime degree specifying signal (1), to the numeric memory 74 through an OR circuit OR3.

The pattern pulse PP indicating the tone production timings of automatic bass tones, which is outputted by the pattern memory 721, is applied to a random data generator 73, which is similar in arrangement to that 73 in FIG. 5. The random data generator 73 operates to assign the applied pattern pulse PP to three output lines at random and to output it as a signal S1, S2 or S3.

These signals S1, S2 and S3 are applied to AND circuits A5, A6 and A7, respectively. The signal PP1 is applied through an inverter to the other inputs of the AND circuits A5, A6 and A7.

Therefore, when the signal PP1 is at "0", the AND circuits A5 through A7 are enabled, and the signal S1 from the random data generator 73 is applied, as the prime degree specifying signal (1) to the numeric memory 74 through the AND circuit A5 and the OR circuit OR3, while the signals S2 and S3 are applied, as the major third degree specifying signal (3) and the fifth degree specifying signal (5) to the memory 74 through the AND circuits A6 and A7, respectively.

When the signal PP1 is at "1", the AND circuits A5, A6 and A7 are disabled to inhibit all the signals S1, S2 and S3 from the random data generator 73, and only the prime degree specifying signal (1) according to the signal PP1 from the pattern memory 721 is applied to the numeric memory 74.

The numeric memory 74, storing numeric data (addend values) representative of a prime degree, a major third degree and a fifth degree corresponding to the prime degree specifying signal (1), the major third degree specifying signal (3) and the fifth degree specifying signal (5), reads out the numeric data representing the shifting intervals in response to the signals (1), (3) and (5) and delivers the numeric data as the constituent degree data SD.

Thus, at the particular tone production timing, for instance at the timing of the note at the top of the measure, or at the timings of the notes at the top and last of the measure, or at the timings of the top and last of the phrase of two measures, the constituent degree data SD (which is zero (0)) indicating the prime degree (root note) is forcibly outputted by the numeric memory 74; and at the other timings the constituent degree data SD indicating the prime degree, the third degree and the fifth degree are outputted at random. Accordingly, the key data KD from the key data processing circuit 5 (FIG. 2) is forcibly made into data representing the root note at the particular timing, and at the other timings the key data corresponding to the root note and the subordinate notes are selected at random, whereby an automatic bass performance is carried out in which only the note at the particular tone production timing is sounded as the root note by the sound system 11.

For instance, the automatic bass performance is such that, when the particular tone production timing corresponds to the note at the top of the measure, the note at the top of each measure is forcibly made to be the root note, and the remaining notes are those which are selected out of the root note and the subordinate notes at random.

Furthermore, in the case where the particular tone production timings correspond to the notes at the top and last of the measure, an automatic bass performance is carried out in which the notes at the top and last of each measure are made to be the root note, and the remaining notes are those which are selected out of the root note and the subordinate notes at random.

In addition, in the case where the particular tone production timings correspond to the notes at the top and last of the phrase of two measures, the automatic bass performance is such that the notes at the top and last of each phrase are forcibly made to be the root note, and the remaining notes are those which are selected from the root note and the subordinate notes at random.

It goes without saying that, in each of the above-described cases, the tones to be produced and the production timings are maintained in a predetermined relationship.

In the example in FIG. 6, an arrangement of changing the subordinate notes (i.e. (3) to (3*b*) and (5) to (7*b*)) according to the kinds of chord is omitted in order to emphasize the subject matter of the embodiment. In practice, however, the arrangement of changing the subordinate notes according to the kinds of chord, which is similar to that in FIG. 5, is of course provided in the example of FIG. 6.

Figure 7:
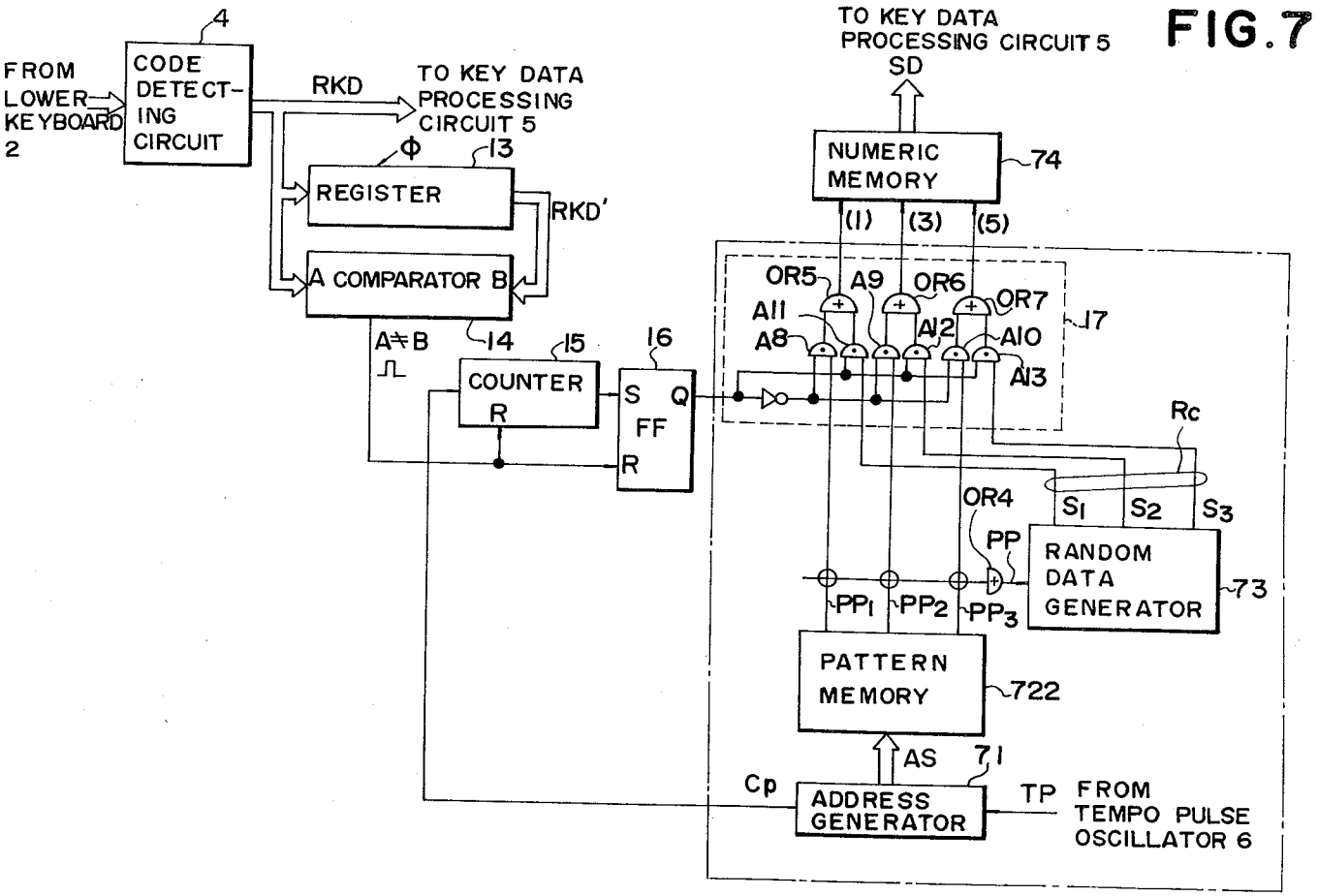
FIG. 7 is a block diagram showing a part of another example of the automatic performance device of the invention.

FIG. 7 shows another example of the automatic performance device according to the invention. With this automatic performance device, a regular automatic performance according to a bass pattern provided by a pattern memory 722 and a random automatic performance are switched over to each other (i.e. alternately used) under the condition that the same root note is specified for more than a predetermined number of measures.

FIG. 7 shows only a part of the automatic performance device, and the remaining parts are similar to those in FIG. 2. In FIG. 7, those components which have been previously described with reference to FIGS. 2 and 3 are therefore designated by the same reference numerals or characters, and the descriptions of them are omitted.

In FIG. 7, pattern pulses PP1, PP2 and PP3 are stored in the pattern memory 722 in correspondence to three different degrees constituting a predetermined bass pattern. The pattern pulses PP1, PP2 and PP3 are read out of the pattern memory 722 in response to an addressing signal AS which is provided by an address generator 71 which is driven by a tempo pulse TP. The timings of generation of the pattern pulses PP1, PP2 and PP3 are the tone production timings of automatic bass tones, and the pattern pulses PP1, PP2 and PP3 indicate the selection of the root note and two subordinate notes. For instance, when the pattern pulse PP2 is provided at a certain tone production timing, then the provision of the pattern pulse PP2 means that a subordinate note having a third degree with respect to the root note is produced at that tone production timing. The pattern memory 722 can be constituted by a read-only memory (ROM).

The pattern pulses PP1 through PP3 from the pattern memory 722 are applied to an OR circuit OR4, the output of which is applied as a pattern pulse PP to a random data generator 73. The random data generator 73 is similar in arrangement to that in FIG. 5. The random data generator 73 assigns the applied pattern pulses PP to one of the signals S1 through S3 at random, so that the one of the signals is outputted as a random data RC. The output signals S1 through S3 from the random data generator 73 are synchronous in generation timing with the pattern pulses PP1 though PP3 from the pattern memory 722; however, they are related at random to the pattern pulses PP1 through PP3. For instance, when the pattern pulse PP1 is outputted by the pattern memory 722, then one of the signals S1 through S3 is outputted by the random data generator 73 in synchronization with the pattern pulse PP1; however, it is not definite which one of the signals S1 through S3 is outputted; that is, in this case, the signals S1 through S3 are outputted at random.

The pattern pulses PP1 through PP3 from the pattern memory 722 and the random data (the signals S1 through S3) from the random data generator 73 are applied to a selection circuit 17. The selection circuit 17 comprises: AND circuits A8 through A10 for selecting the pattern pulses PP1 through PP3 outputted by the pattern memory 722; AND circuits A11 through A13 for selecting the output signals S1 through S3 of the random data generator 73; and OR circuits OR5 through OR7, to select one of the signals PP1 through PP3 or S1 through S3.

The selection control of the selection circuit 17 depends on whether or not the same root note (chord name) is specified continuously for more than a predetermined number of measures. As was described before, the signals representative of the keys depressed in the lower keyboard 2 are applied to the chord detecting circuit 4. The chord detecting circuit 4 detects the root note from the signals thus applied, to output a root note key code RKD representative of the root note. The root note key code RKD is applied to the key data processing circuit 5 (FIG. 2) and to a register 13, where it is stored. The signal stored in the register 13 (i.e. the output signal of the register 13) is compared with a signal applied to the register 13 (i.e. the input signal of the register 13) in a comparator 14. Since the register 13 is operated in response to a clock pulse $\phi$ having a predetermined period, the input signal of the register 13 is the root note key data RKD representative of the root note (chord name) which is specified by depressing keys in the lower keyboard 2 at present, while the output signal of the register 13 is a root note key data RKD' which was provided one period of the clock pulse $\phi$ before.

In the comparator 14, the present root note key data RKD is compared with the preceding root note key data RKD', and when they are not coincident with each other, a non-coincidence signal $A \neq B$ is outputted. The non-coincidence signal $A \neq B$ is a pulse signal having a pulse width corresponding to one period of the clock pulse $\phi$. The provision of the non-coincidence signal $A \neq B$ means that the root note (chord) is now changed.

For instance, when, under the condition that no key is depressed in the lower keyboard 2 (i.e. under the condition that no root note is specified) before a performance is started, keys are depressed in the lower keyboard 2 to specify the root note (chord name), then the input signal of the register 13 is different from the output signal of the register 13, as a result of which the non-coincidence signal $A \neq B$ is outputted by the comparator 14.

The non-coincidence signal $A \neq B$ is applied to the reset terminal R of a counter 15 to reset the counter 15, and it is further applied to the reset terminal R of a flip-flop 16 to reset the flip-flop 16. Under this condition, the output Q of the flip-flop 16 is at "0", whereby the AND circuits A8 through A10 in the selection circuit 17 are enabled, and therefore the selection circuit 17 selects the pattern pulses PP1 through PP3 outputted by the pattern memory 722. The outputs of the selection circuit 17 are applied, as the prime degree specifying signal (1), the third degree specifying signal (3) and the fifth degree specifying signal (5), to a numeric memory 74, respectively. The numeric memory 74 is similar to that in FIG. 6. The numeric memory 74 provides numeric data (addend values) representative of a prime degree, a third degree and a fifth degree respectively for the signals (1), (3) and (5), and applied the numeric data, as constituent degree data SD, to the key data processing circuit 5. Thus, at the start of the performance, the pattern pulses PP1 through PP3 outputted by the pattern memory 722 are first selected (utilized), and an automatic bass performance according to the pattern pulses PP1 through PP3 is carried out.

The counter 15 which is reset by the non-coincidence signal $A \neq B$ from the comparator 14 is adapted to count the number of measures for which the same root note (chord name) is continously specified.

A measure pulse Cp from an address generator 71 is applied to the count input of the counter 15. The measure pulse Cp is produced at the start of each measure. Therefore, if a counter forming the address generator 71 is so designed as to count tempo pulses for one measure, then the carry signal of the counter can be employed as the measure pulse Cp.

The counter 15 counts the measure pulses Cp applied thereto, and outputs a signal "1" when its count value reaches a predetermined value.

The counter 15 may be a counter having a modulus corresponding to the predetermined value, so as to employ its carry signal as an output signal. Furthermore, the counter may be so designed that it has a function of setting a predetermined value, and produces an output signal by comparing the predetermined value with its count value.

The count value of the counter 15 is reset by the non-coincidence signal $A \neq B$ which is provided by the comparator 14 whenever the root note specified by the lower keyboard 2 is changed. Therefore, in order to cause the counter 15 to output a signal "1", it is necessary that the same root note (chord name) is specified continuously for more than a predetermined number of measures.

It is assumed that the value set for the counter 15 is three (3). If, in this case, the same root note (chord name) is specified continuously for more than two measures, then at the start of the third measure the counter 15 outputs the signal "1".

The signal "1" outputted by the counter 15 is applied to the set terminal S of the flip-flop 16, as a result of which the flip-flop 16 is set and the output signal Q is raised to "1". When the output signal Q of the flip-flop 16 is raised to "1", the AND circuits A11 through A13 in the selection circuit 17 are enabled, to permit the selection circuit 17 to select the output signals S1 through S3 of the random data generator 17. As a result, the regular automatic bass performance which has been carried out according to the output pattern pulses PP1 through PP3 of the pattern memory 722 is switched over to a random automatic bass performance according to the output signals S1 through S3 of the random data generator 73.

As described above, in the case where the value set for the counter 15 is three (3), when the same root note (chord name) is specified continuously for more than two measures, the regular automatic bass performance is switched over to the random automatic bass performance at the start of the third measure. In this case, the same regular automatic bass performance is carried out for two measures, and it is switched over to the random automatic bass performance at the third measure.

The random automatic bass performance is continued unless the root note (chord name) specification by the lower keyboard 2 is changed.

When the keys depressed in the lower keyboard 2 are changed, i.e. the root note (chord name) is changed, the comparator 15 outputs the non-coincidence signal $A \neq B$. As a result, the flip-flop 16 is reset, and the selection circuit 17 is switched to select the pattern pulses PP1 through PP3 outputted by the pattern memory 722.

Thus, the random automatic bass performance is switched back to the regular automatic bass performance.

If, in the case where the value set for the counter 15 is two (2), the same root note (chord name) is specified continuously for more than one measure, then at the start of the second measure the regular automatic bass performance is switched over to the random automatic bass performance. In other words, if the same root note (chord name) is specified continously for more than one measure, the regular automatic bass performance is carried out for the first measure, but the random automatic bass performance is carried out for the following measures. In this case, the regular automatic bass performance according to the same root note (chord name) is not continued for more than one measure, and therefore the automatic bass performance is considerably rich in variation.

Figure 8:
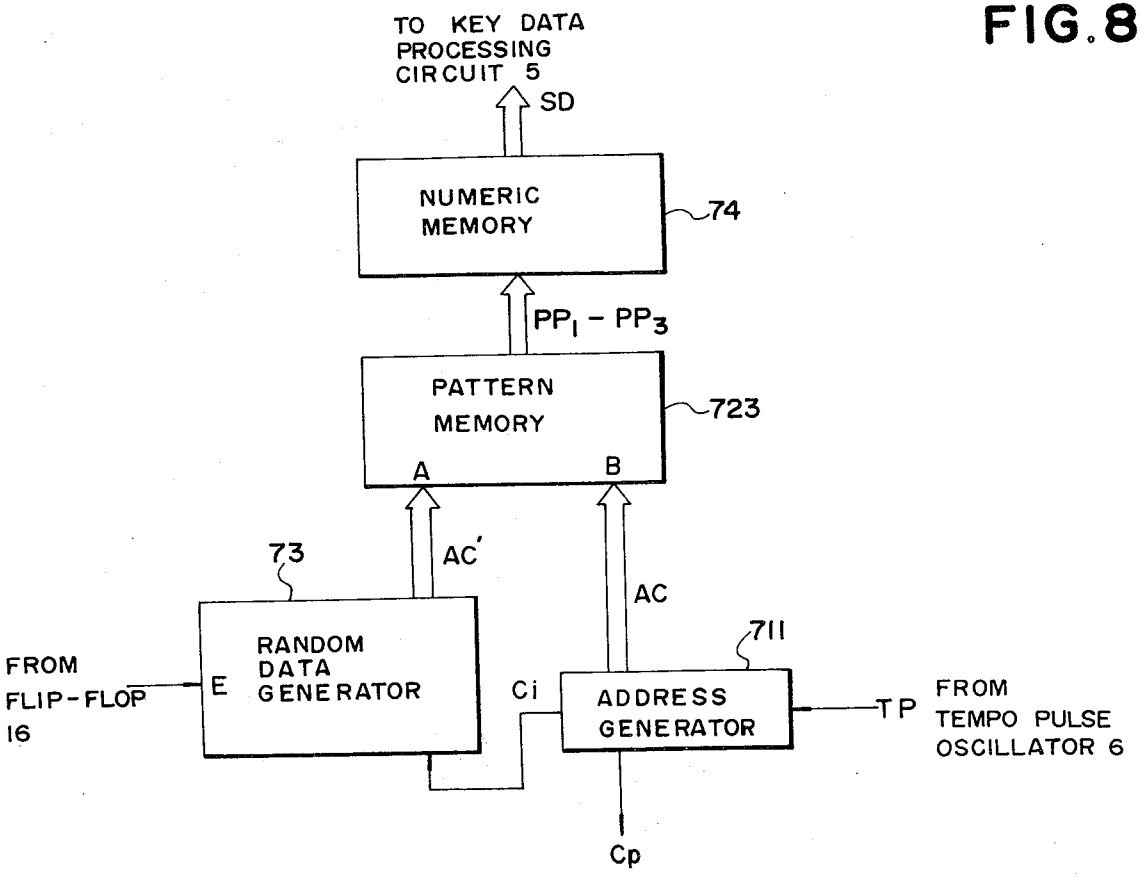
FIG. 8 is a block diagram showing another example of a circuit surrounded by the one-dot chain line in FIG. 7.

FIG. 8 shows a third example of the automatic performance device according to the invention, in which the tone production oftenness of each of the root note and subordinate notes to be produced is set to a predetermined ratio. The circuit shown in FIG. 8 corresponds to a block indicated by the one-dot chain line in FIG. 7, and the remaining circuits of the automatic performance device are similar to those in the example of FIG. 7.

An address generator 711 is driven by the tempo pulse TP from the tempo pulse generator 6 (FIG. 2) to provide an addressing signal AC for a pattern memory 723. The address generator 711 is constituted by a counter which produces the addressing signal AC for two measures. The address generator 711 provides a 2-measure pulse Ci at its carry terminal for every two measures, and provides a 1-measure pulse Cp at the second most significant bit output for every measure. The 2-measure pulse Ci from the address generator 711 is applied to a random data generator 73.

The random data generator 73 is similar in circuit arrangement to that in FIG. 4, and assigns at random the 2-measure pulse Ci to one of a plurality of outputs. The output of the random data generator 73 is employed as a static addressing signal AC' for a pattern memory 723, as described later. The output signal Q of the flip-flop 16 (FIG. 7) is applied to the enable terminal E of the random data generator 73. Therefore, as long as the flip-flop 16 is not set, the random data generator 73 is maintained disabled, and therefore all of its outputs are maintaned at "0".

The pattern memory 723 is made up of a plurality of read-only memories (ROM's) which store the pattern pulses PP1 through PP3 corresponding to a bass pattern for two measures. The pattern pulses PP1 through PP3 stored in one of the read-only memoreis (ROM's) correspond to a bass pattern for a regular automatic bass performance, and the pattern pulses PP1 through PP3 stored in the other read-only memories correspond to a bass pattern for a random automatic bass performance.

The addressing signal AC applied to the input B of the pattern memory 723 from the address generator 711 is applied commonly as a dynamic addressing signal to the above-described read-only memories (ROM's). The static addressing signal AC' from the random data generator 73 is used to enable one of the read-only memories (ROM's).

For instance, in the case where the number of the outputs of the random data generator 73 is five (5), the pattern memory 723 is made up of six (6) read-only memories. One of the six read-only memories is selected when all of the outputs of the random data generator 73 are at "0", and the remaining read-only memories are selected depending on which one of the five outputs is raised to "1". The pattern pulses PP1 through PP3 stored in the read-only memory which is selected when all of the outputs of the random data generator 73 are at "0" are for the regular automatic bass performance, and the pattern pulses PP1 through PP3 stored in the remaining read-only memories are for a random automatic bass performance.

The pattern pulses PP1 through PP3 stored in the remaining read-only memories are different in content from one another. In the example in FIG. 8, one of the pattern pulses PP1 through PP3 is selected at random according to the output of the random data generator 73, thereby to carry out the random automatic bass performance.

The pattern pulses PP1 through PP3 stored in the read-only memories for the random automatic bass performance are different in content from one another as described above; however, the tone production oftenness of each of the root and subordinate notes in two measures is set to a predetermined value. The tone production oftenness is so set for each of the pattern pulses PP1 through PP3 that, for instance, the root note (of a prime degree) and the subordinate note of the third degree are produced respectively three times in two measures and the subordinate note of the fifth degree is produced two times in two measures; however, it depends on the read-only memories which note corresponds to a pattern pulse (one of the pattern pulses PP1 through PP3) provided at a given tone production timing.

It is assumed that the same root note (chord name) is not specified continuously for the predetermined number of measures and the flip-flop 16 (FIG. 7) is in reset state. In this case, a signal "0" is applied to the enable terminal E of the random data generator 73, and therefore the generator 73 is disabled. Accordingly, all the bits of the addressing signal AC' applied to the input A of the pattern memory 723 are at "0", and in the pattern memory 723 the read-only memory for storing the pattern pulses PP1 through PP3 for the regular automatic bass performance is selected and enabled. As a result, the pattern pulses PP1 through PP3 according to the bass pattern for the regular automatic bass performance are successively outputted by the pattern memory 723 in response to the addressing signal AC from the address generator 711. The pattern pulses PP1 through PP3 are applied to a numeric memory 74 which is similar to that in FIG. 7. The numeric memory 74 outputs numeric data (addend values) representative of the prime degree (root note), the third degree and the fifth degree in response to the pattern pulses PP1, PP2 and PP3, respectively. The numeric data are applied, as constituent degree data SD, to the key data processing circuit 5. Thus, in this case, an automatic bass performance according to the bass pattern for the ordinary pattern (regular) automatic bass performance is carried out.

In the case where the same root note (chord name) is specified continuously for more than the predetermined number of measures and the flip-flop 16 (FIG. 7) is set, the random data generator 72 is enabled to output the addressing signal AC' varying for every two measures in response to the 2-measure pulse Ci from the address generator 711. The addressing signal AC thus outputted is applied to the input A of the pattern memory 723 to select one of the read-only memories adapted to store the pattern pulses PP1 through PP3 for a random automatic bass performance, and to enable the read-only memory thus selected. As a result, in the pattern memory 723, the pattern pulses PP1 through PP3 for the random automatic bass performance are outputted by one of the read-only memories adapted to store the pattern pulses PP1 through PP3 for the random automatic bass performance, in response to the addressing signal AC from the address generator 711; that is, the regular automatic bass performance is switched over to the random automatic bass performance. When the root note specified by the lower keyboard 2 (FIG. 2) is changed, the flip-flop 16 (FIG. 2) is reset, as a result of which the random automatic bass performance is switched back to the regular automatic bass performance.

In each of the examples of the automatic performance device in FIGS. 7 and 8, the arrangement of changing subordinate notes (i.e. (3) to (*3b*) and (5) to (*7b*)) according to the kinds of chord is omitted; however, it goes without saying that the subordinate notes can be changed according to the kinds of chord if a circuit similar to that in FIG. 5 is provided therefor.

Figure 9:
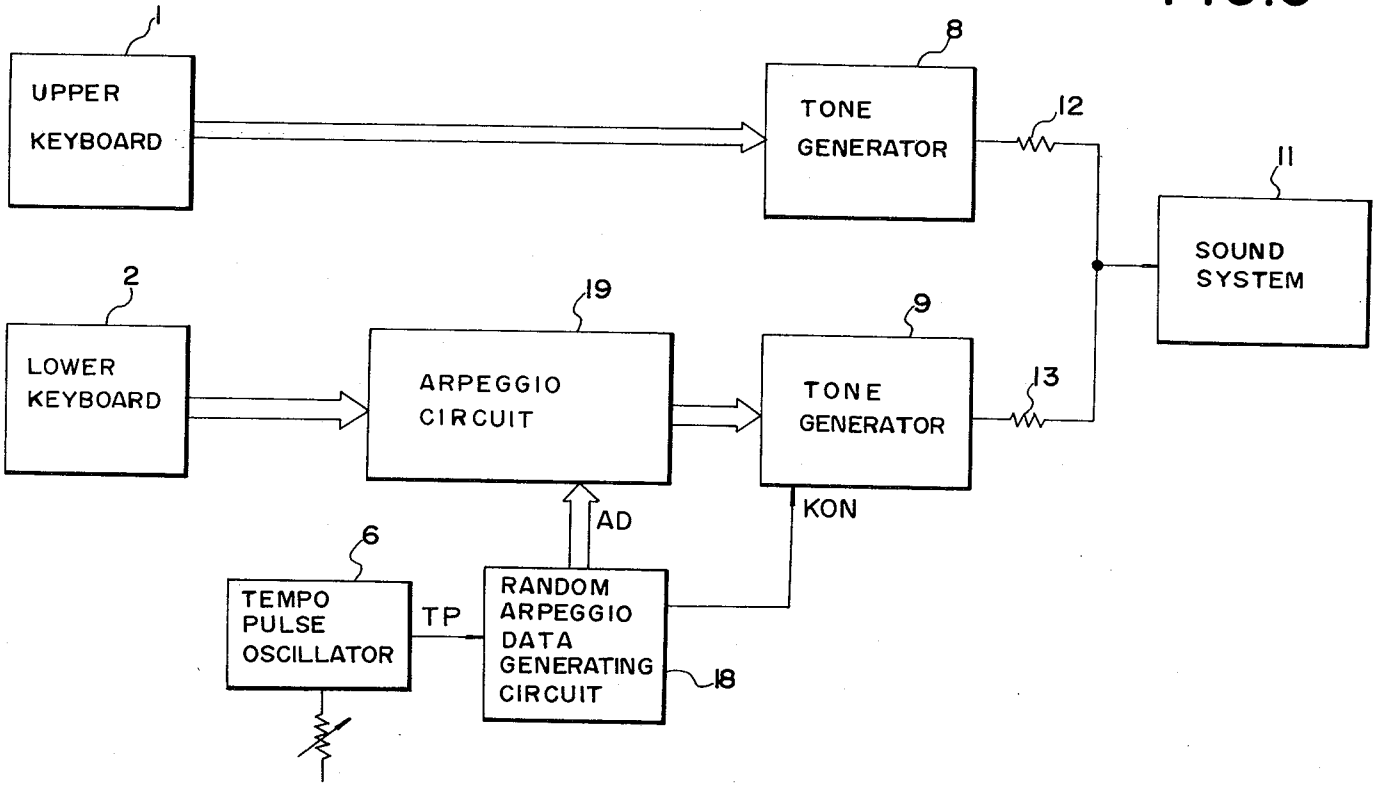
FIG. 9 is a block diagram showing a third example of the automatic performance device according to the invention.

FIG. 9 shows one example of an arpeggio automatic performance device to which the technical concept of the automatic performance device of the invention is applied. In the example, a random automatic arpeggio performance is carried out according to a random arpeggio data AD which is provided by a random arpeggio data generating circuit 18. In FIG. 9, those components which have been already described with reference to FIG. 2 are therefore similarly numbered, and the descriptions of them are omitted.

In FIG. 9, an arpeggio circuit 19 provides signals representative of automatic arpeggio tones successively according to signals representing the tones of a single or a plurality of keys depressed in the lower keyboard 2. The provision of the signal representing the automatic arpeggio tone is carried out according to the arpeggio data AD outputted by the random arpeggio data generating circuit 18. That is, the arpeggio data AD represents data to select one of the tones of a single or a plurality of keys depressed in the lower keyboard 2, and its generation timings represent the tone production timings of the automatic arpeggio tone. In the arpeggio circuit 19, one of the signals representative of the tones of the keys depressed in the lower keyboard 2 is selected according to the arpeggio data AD, and according to the signal thus selected a signal representing an automatic arpeggio tone to be produced is formed. The arpeggio circuit as described above may be one which is similar to a circuit disclosed in U.S. Patent Application Ser. No. 952,098 entitled "Electronic Musical Instrument with Automatic Arpeggio Performance Device" now U.S. Pat. No. 4,217,804 or in the unexamined publication No. 1979-58429 of the corresponding Japanese patent application.

In the above-described circuit, arpeggio patterns AP1 through AP4 are employed as the arpeggio data AD, and the arpeggio patterns AP1 through AP4 are to indicate the location orders of the tones counted from a particular one (for instance the lowest one) of the tones of keys depressed in the lower keyboard.

The random arpeggio data generating circuit 18, receiving the tempo pulse TP from the tempo pulse oscillator 6, produces the arpeggio data AD successively at predetermined timings (for instance, timings corresponding to a selected rhythm), and outputs key-on signals KON in synchronization with the timings of production of the arpeggio data AD. The arpeggio data AD from the random arpeggio data generating circuit 18 consists of data (numeric data) to select one of the tones of keys depressed in the lower keyboard 2 as described above; however, it is so formed that the tones are selected at random at a given arpeggio tone production timing.

In other words, the timing of generation of the arpeggio data AD from the random arpeggio data generating circuit 18 is synchronous with the predetermined arpeggio tone production timing corresponding to the selected rhythm or the like; however, selection of tones at given timings is made at random.

The random arpeggio data generating circuit 18 may be made up of a circuit which is similar to the random constituent degree data generating circuit 7 shown in FIG. 3. or 4. In this case, the circuit 18 is so formed that the arpeggio data AD are stored in the addresses in the numeric memory 74 (FIG. 2).

Thus, the arpeggio circuit 19 produces one after another the signals representing automatic arpeggio tones, which are such that the tone represented by the signal is one of the tones of the keys depressed in the lower keyboard 2 and its generation timing corresponds to a selected rhythm or the like; however, its selection of tones at given tone production timings is made at random.

The signals representing the automatic arpeggio tones which are provided successively by the arpeggio circuit 19 are applied to a tone generator 9. In the tone generator 9, musical tone signals representative of the automatic arpeggio tones are formed according to the signals representing the automatic arpeggio tones and the key-on signals KON from the arpeggio data generating circuit 18. The musical tone signals thus formed are applied through a mixing resistor 13 to a sound system 11, where they are sounded as random automatic arpeggio tones.

In the above-described example, the degree of randomness of automatic arpeggio tones is not particularly limited; however, the following limitations may be applied similarly as in the case of the above-described automatic bass performance:

(1) Notes at particular tone production timings are forcibly made to be a reference note.

(2) The tone production oftenness of each of the notes to be produced is set to a predetermined ratio. For this purpose, a circuit similar to that described with respect to the automatic bass performance device can be employed.

As is apparent from the above description, according to the invention the automatic performance is carried out, in which the tone production timings and the degrees of notes to be produced are maintained in predetermined relationship, but notes to be produced at respective tone production timings are selected at random out of the plural notes having the above-described predetermined relationship. Therefore, the monotony accompanying the automatic performance is eliminated, and the performance itself becomes fresh considerably. Thus, the musical effect of the automatic performance can be remarkably improved.

What is claimed is:

1. An automatic performance device comprising:

keys specifying notes to be played;

reference note specifying means coupled with said keys for specifying a reference note in response to depression of the keys;

a random data generating circuit for generating, one at a time but in random selection order, a plurality of data respectively representing the reference note and notes which are in prdetermined note-interval relations with said reference note at respective ones of predetermined timings constituting a rhythm in a successive alignment of measures forming a music progression; and musical tone producing means connected to said random data generating circuit for producing tones according to said data generated by said random data generating circuit.

2. A device as claimed in claim 1, in which said random data generating circuit has means for making data generated at selected timings among said predetermined timings to be the data representing said reference note.

3. A device as claimed in claim 2, in which said selected timings are first timings among said predetermined timings within the respective measures to be performed.

4. A device as claimed in claim 2, in which said selected timings are first and last timings among said predetermined timings within the respective measures.

5. A device as claimed in claim 2, in which said selected timings are first and last timings among said predetermined timings within a phrase of plural measures as one unit.

6. A device as claimed in claim 1, in which numbers of times of respective generations of said plural data are set at predetermined ratios of occurrence in said random data generating circuit.

7. In an electronic musical instrument having an automatic performance device in which a reference note and subordinate notes having predetermined note interval relations to said reference note are produced sequentially in a fixed temporal pattern established by a tempo pulse generator, the improvement for automatically producing at least some of said reference and subordinate notes in a random selection order, comprising:

memory means for providing subordinate note degree date which, when combined with data representing said reference note, forms key data usable by said instrument to produce corresponding musical notes, a random data generator, operatively synchronized with said tempo pulse generator, for producing random data, and note selection circuit means, cooperating with said random data generator and said memory means, to cause readout from said memory means of at least some of said subordinate note degree data in random order established by said random data, but in said fixed temporal pattern.

8. An automatic performance device comprising:

keys specifying notes to be played;

reference note specifying means coupled with said keys for specifying a reference note in response to depression of the keys;

a pattern data generating circuit for generating, one at a time and in a predetermined selection order, a plurality of data respectively representing the reference note and notes which are in predetermined note-interval relations with said reference note at respective ones of predetermined timings constituting a rhythm in a successive alignment of measures forming a music progression;

a random data generating circuit for generating, one at a time but in random selection order, a plurality of data respectively representing the reference note and notes which are in predetermined note-interval relations with said reference note at respective ones of predetermined timings;

a selection circuit for selecting one of an output of said pattern data generating circuit and an output of said random data generating circuit;

switching means for switching the operation of said selection circuit from the selection of the output of said pattern data generating circuit over to the selection of the output of said random data generating circuit, when a same reference note has been specified continuously for more than a predetermined number of said measures; and musical tone producing means for producing tones according to the output of said selection circuit.

9. A device as claimed in claim 8, in which said random data generating circuit has means for making data generated at selected timings among said predetermined timings to be the data representing said reference note.

10. A device as claimed in claim 8, in which numbers of times of respective generations of said plural data are set at predetermined ratios of occurrence in said random data generating circuit.

* * * * *